US006783441B2

(12) United States Patent
Liang et al.

(10) Patent No.: US 6,783,441 B2
(45) Date of Patent: Aug. 31, 2004

(54) APPARATUS AND METHOD FOR TRANSFERRING A TORQUE FROM A ROTATING HUB FRAME TO A ONE-PIECE HUB SHAFT

(75) Inventors: Yao Hsiang Liang, Kaohsiung (TW); Wen-Ten Chan, Taipai (TW)

(73) Assignee: Taiwan Semiconductor Manufacturing Co., Ltd., Hsin Chu (TW)

( * ) Notice: Subject to any disclaimer, the term of this patent is extended or adjusted under 35 U.S.C. 154(b) by 227 days.

(21) Appl. No.: 09/928,057

(22) Filed: Aug. 10, 2001

(65) Prior Publication Data

US 2003/0032374 A1 Feb. 13, 2003

(51) Int. Cl.[7] ..... B24B 1/00; B24B 41/00

(52) U.S. Cl. ..... 451/56; 451/72; 451/342; 451/443

(58) Field of Search ..... 451/21, 56, 72, 451/443, 342, 343; 403/359.1, 359.6; 29/428, 433, 464, 468

(56) References Cited

U.S. PATENT DOCUMENTS 5,531,537 A * 7/1996 Pink et al. ..... 403/356
5,923,009 A * 7/1999 Cheng ..... 200/50.01
6,376,954 B1 * 4/2002 Nunes, Jr. ..... 310/91
6,482,074 B1 * 11/2002 Chang et al. ..... 451/28

* cited by examiner

*Primary Examiner*—Timothy V. Eley
(74) *Attorney, Agent, or Firm*—Tung & Associates

(57) ABSTRACT

An apparatus and a method for transferring a rotational torque from a hub frame to a one-piece hub shaft onto which a pad conditioning disc is attached are described. The apparatus is a one-piece hub shaft for mounting into a hub-frame. To provide a great improvement over the conventional design wherein a hub spacer is mounted to a hub shaft by screw means, the present invention conditioning head is assembled together by frictionally engaging a key and a flat surface on the hub shaft to a slot opening on the hub frame such that any catastrophic failure due to a screw breakage can be avoided. The present invention novel frictional engagement further provides a more uniform torque transfer between the two components.

15 Claims, 2 Drawing Sheets

APPARATUS AND METHOD FOR TRANSFERRING A TORQUE FROM A ROTATING HUB FRAME TO A ONE-PIECE HUB SHAFT

FIELD OF THE INVENTION

The present invention generally relates to an apparatus and a method for transferring a torque from a hub frame to a one-piece hub shaft and more particularly, relates to an apparatus and a method for transferring a torque from a rotating hub frame to a one-piece hub shaft without using connecting bolts between components of a hub shaft such that a possible breakage of the bolts and the resultant catastrophic failure of the apparatus can be avoided.

BACKGROUND OF THE INVENTION

Apparatus for polishing thin, flat semi-conductor wafers is well-known in the art. Such apparatus normally includes a polishing head which carries a membrane for engaging and forcing a semiconductor wafer against a wetted polishing surface, such as a polishing pad. Either the pad, or the polishing head is rotated and oscillates the wafer over the polishing surface. The polishing head is forced downwardly onto the polishing surface by a pressurized air system or, similar arrangement. The downward force pressing the polishing head against the polishing surface can be adjusted as desired. The polishing head is typically mounted on an elongated pivoting carrier arm, which can move the pressure head between several operative positions. In one operative position, the carrier arm positions a wafer mounted on the pressure head in contact with the polishing pad. In order to remove the wafer from contact with the polishing surface, the carrier arm is first pivoted upwardly to lift the pressure head and wafer from the polishing surface. The carrier arm is then pivoted laterally to move the pressure head and wafer carried by the pressure head to an auxiliary wafer processing station. The auxiliary processing station may include, for example, a station for cleaning the wafer and/or polishing head, a wafer unload station, or a wafer load station.

More recently, chemical-mechanical polishing (CMP) apparatus has been employed in combination with a pneumatically actuated polishing head. CMP apparatus is used primarily for polishing the front face or device side of a semiconductor wafer during the fabrication of semiconductor devices on the wafer. A wafer is "planarized" or smoothed one or more times during a fabrication process in order for the top surface of the wafer to be as flat as possible. A wafer is polished by being placed on a carrier and pressed face down onto a polishing pad covered with a slurry of colloidal silica or alumina in de-ionized water.

A schematic of a typical CMP apparatus is shown in FIGS. 1A and 1B. The apparatus 20 for chemical mechanical polishing consists of a rotating wafer holder 14 that holds the wafer 10, the appropriate slurry 24, and a polishing pad 12 which is normally mounted to a rotating table 26 by adhesive means. The polishing pad 12 is applied to the wafer surface 22 at a specific pressure. The chemical mechanical polishing method can be used to provide a planar surface on dielectric layers, on deep and shallow trenches that are filled with polysilicon or oxide, and on various metal films. CMP polishing results from a combination of chemical and mechanical effects. A possible mechanism for the CMP process involves the formation of a chemically altered layer at the surface of the material being polished. The layer is mechanically removed from the underlying bulk material.

An altered layer is then regrown on the surface while the process is repeated again. For instance, in metal polishing a metal oxide may be formed and removed repeatedly.

A polishing pad is typically constructed in two layers overlying a platen with the resilient layer as the outer layer of the pad. The layers are typically made of polyurethane and may include a filler for controlling the dimensional stability of the layers. The polishing pad is usually several times the diameter of a wafer and the wafer is kept off-center on the pad to prevent polishing a non-planar surface onto the wafer. The wafer is also rotated to prevent polishing a taper into the wafer. Although the axis of rotation of the wafer and the axis of rotation of the pad are not collinear, the axes must be parallel.

The polishing pad is a consumable item used in a semiconductor wafer fabrication process. Under normal wafer fabrication conditions, the polishing pad is replaced after about 12 hours of usage. Polishing pads may be hard, incompressible pads or soft pads. For oxide polishing, hard and stiffer pads are generally used to achieve planarity. Softer pads are generally used in other polishing processes to achieve improved uniformity and smooth surface. The hard pads and the soft pads may also be combined in an arrangement of stacked pads for customized applications.

A problem frequently encountered in the use of polishing pads in oxide planarization is the rapid deterioration in oxide polishing rates with successive wafers. The cause for the deterioration is known as "pad glazing" wherein the surface of a polishing pad becomes smooth such that the pad no longer holds slurry in-between the fibers. This is a physical phenomenon on the pad surface not caused by any chemical reactions between the pad and the slurry.

To remedy the pad glazing effect, numerous techniques of pad conditioning or scrubbing have been proposed to regenerate and restore the pad surface and thereby, restoring the polishing rates of the pad. The pad conditioning techniques include the use of silicon carbide particles, diamond emery paper, blade or knife for scrapping the polishing pad surface. The goal of the conditioning process is to remove polishing debris from the pad surface, re-open the pores, and thus forms micro-scratches in the surface of the pad for improved life time. The pad conditioning process can be carried out either during a polishing process, i.e. known as concurrent conditioning, or after a polishing process.

A conventional conditioning disc for use in pad conditioning is shown in FIG. 1C in a perspective view of a CMP apparatus 50. The apparatus 50 consists of a conditioning head 52 which includes a conditioning disc 68 mounted to a hub frame 70, a polishing pad 56, and a slurry delivery arm 54 positioned over the polishing pad. The conditioning head 52 is mounted on a conditioning arm 58 which is extended over the top of the polishing pad 56 for making sweeping motion across the entire surface of the pad. The slurry delivery arm 54 is equipped with slurry dispensing nozzles 62 which are used for dispensing a slurry solution on the top surface 60 of the polishing pad 56. Surface grooves 64 are further provided in the top surface 60 to facilitate even distribution of the slurry solution and to help entrapping undesirable particles that are generated by coagulated slurry solution or any other foreign particles which have fallen on top of the polishing pad during a polishing process.

Inside the conditioning head 52, is a hub shaft 72 integrally formed with a circular disc 74 at a lower end. This is shown in FIG. 2. The hub shaft 72, when assembled with a hub spacer 76 on a flat surface 78 on the shaft can be inserted into a hub frame 70 (shown in FIG. 1) for transferring a rotational torque from the hub frame 70 to a conditioning disc 68 (shown in FIG. 1). The hub spacer 76 is fastened to the hub shaft 72 by two screws 82 and is equipped with a protruded pin 84 on a top surface 86 of the hub spacer 76. The pin 84 is used to engage a recessed slot (not shown) provided in the hub frame 70 (shown in FIG. 1) such that the hub shaft 72 can be easily assembled or disassembled. Since the conditioning disc 68 which consists of the hub shaft 72, the hub spacer 76 and the circular disc 74 operates in high torque during the pad conditioning process, the screws 82 that fasten the hub spacer 76 to the hub shaft 72 frequently break under such high torque operating conditions. When a failure, or breakage of the screws 82 occurs, the hub shaft 72 becomes loose from the hub frame 70 and causes a catastrophic failure of the conditioning head 52. Such failure leads to a total breakdown of the chemical mechanical polishing apparatus and a significant drop in the fabrication yield.

It is therefore an object of the present invention to provide an apparatus for transferring a rotational torque from a hub frame to a one-piece hub shaft that does not have the drawbacks or shortcomings of the conventional apparatus.

It is another object of the present invention to provide an apparatus for transferring a rotational torque from a hub frame to a one-piece hub shaft that does not require bolts for the assembly of the hub shaft.

It is a further object of the present invention to provide an apparatus for transferring a rotational torque from a hub frame to a one-piece hub shaft that utilizes a hub spacer compression fitted to the hub shaft for the torque transfer.

It is still another object of the present invention to provide an apparatus for transferring a rotational torque from a hub frame to a one-piece hub shaft wherein the torque is effectively transferred by a flat surface and a key provided on the one-piece hub shaft.

It is yet another object of the present invention to provide a method for transferring a rotational torque from a hub frame to a one-piece hub shaft by first providing a flat surface and a key on the one-piece hub shaft and then inserting the hub shaft into the hub frame to transfer the torque.

SUMMARY OF THE INVENTION

In accordance with the present invention, an apparatus and a method for transferring a rotational torque from a hub frame to a one-piece hub shaft for driving a pad conditioning disc are provided.

In a preferred embodiment, an apparatus for transferring a torque from a hub frame to a one-piece hub shaft is provided which includes a hub frame of generally circular configuration having a center aperture therethrough adapted for receiving a one-piece hub shaft; a one-piece hub shaft of elongated shape having generally a circular cross-section and a disc integrally formed at a low end, the one-piece hub shaft has a flat surface along a periphery and a full length and the key of the shaft and a key on the flat surface such that the flat surface and the key intimately engage an opening in the hub frame for transferring a rotational torque from the hub frame to the hub shaft.

In the apparatus for transferring a torque from a hub frame to a one-piece hub shaft, the hub frame may further include a slot recess in the center aperture adapted for receiving the flat surface and the key on the one-piece hub shaft. The hub frame transfers a rotational motion to the one-piece hub shaft for driving a conditioning disc mounted on the circular disc, or transfers an up-and-down motion to the one-piece hub shaft for engaging and disengaging a conditioning disc mounted on the circular disc to and from a polishing pad. The flat-surface on the hub shaft may have a depth of at least 2 mm for transferring the rotational torque. The key on the hub spacer may have a rectangular-shape for engaging the recess in the hub frame. The circular disc on the one-piece hub shaft may be adapted for receiving a conditioning disc thereon. The apparatus may be adapted for mounting into a chemical mechanical polishing apparatus. The key may be integrally formed with the flat surface.

The present invention is further directed to a method for transferring a torque from a hub frame to a one-piece hub shaft which can be carried out by the operating steps of first providing a hub frame of generally circular configuration that has a center aperture therein adapted for receiving a one-piece hub shaft; providing a one-piece hub shaft of elongated shape that has generally a circular cross-section along a periphery and a full length of the shaft and a key on the flat surface; and inserting the one-piece hub shaft into the center aperture of the hub frame such that any rotational torque of the hub frame is transferred to the hub shaft.

The method may further include the step of transferring a rotational motion from the hub frame to the one-piece hub shaft and driving a conditioning disc mounted on the circular disc, or the step of transferring an up-and-down motion from the hub frame to the one-piece hub shaft and engaging or disengaging a conditioning disc mounted on the circular disc to or from a polishing pad. The method may further include the step of forming the flat surface on the hub shaft to a depth of at least 2 mm for transferring the rotational torque. The method may further include the step of providing the key on the flat surface of the one-piece hub shaft with a rectangular shape for engaging the recess in the hub frame, or the step of providing the circular disc on the hub shaft to receive a conditioning disc thereon, or the step of mounting the apparatus in a chemical mechanical polishing machine.

BRIEF DESCRIPTION OF THE DRAWINGS

These and other objects, features and advantages of the present invention will become apparent from the following detailed description and the appended drawings in which.

DETAILED DESCRIPTION OF THE PREFERRED EMBODIMENT

The present invention discloses an apparatus and a method for transferring a rotational torque from a hub frame to a one-piece hub shaft that drives a rotational disc. While the present invention apparatus and method is applicable to a torque transfer from any rotating member to a rotating shaft, it is particularly suited for transferring a rotational torque from a hub frame to a one-piece hub shaft for driving a rotating conditioning disc in a chemical mechanical polishing apparatus.

The apparatus is constructed by a hub frame and a hub shaft wherein a flat surface and key are provided on the one-piece hub shaft and then the shaft is inserted into the hub frame. Instead of a conventional method of first connecting a hub spacer to the hub shaft by screws or bolts, the present invention hub shaft has a hub spacer integrally formed therein without using screws or bolts such that any failure of the apparatus due to screw breakage can be avoided.

In a chemical mechanical polishing apparatus that is equipped with in-situ pad conditioning, the pad conditioner moves up-and-down and rotates in a rotational motion by a traveling shaft to condition the polishing pad on demand. The present invention discloses the use and the incorporation of a flat surface and a metal key on a traveling hub shaft for transferring a torque between a hub frame and a hub shaft and for allowing a linear up-and-down motion of a diamond disc holder. The present invention novel apparatus and method therefore eliminates the possibility of screw breakage in the conventional hub spacer/hub shaft assembly which may otherwise cause catastrophic failure of the polishing system. When such failure occurs, a polished wafer must be reworked in order to be further processed.

The present invention further discloses a novel method of utilizing a flat surface and metal key on the surface of a one-piece hub shaft to ensure that a torque is uniformly distributed on the flat surface and the key during a torque transfer from a hub frame to the one-piece hub shaft in rotating a conditioning disc. The method not only saves manpower for maintaining a pad conditioner, lowers the rework rate of wafers, but also enables a higher fabrication yield of the CMP process. Instead of using screws or bolts in the conventional assembly, the invention utilizes a one-piece hub shaft with integrally formed flat surface and key such that either a rotational torque or a linear torque may be transferred without causing failure in any of the components.

Figure 1A:
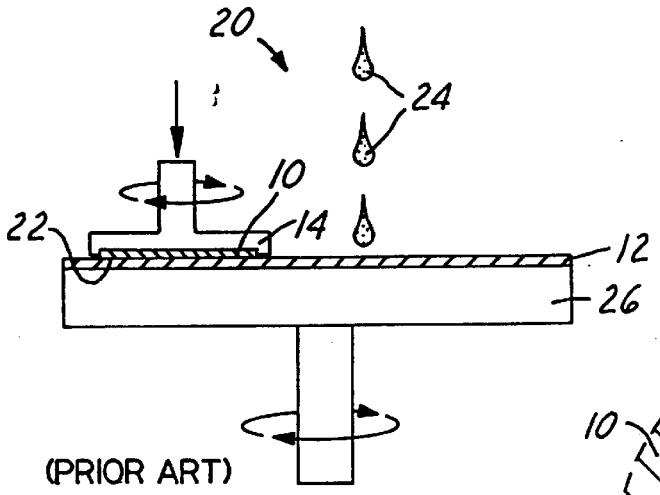
(PRIOR ART) FIG. 1A
FIG. 1A is a cross-sectional view of a conventional chemical mechanical polishing apparatus.
Figure 1B:
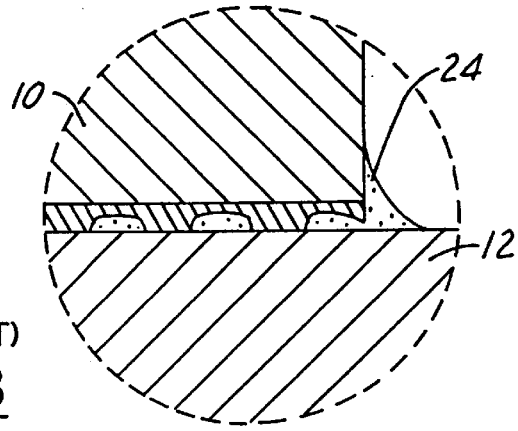
(PRIOR ART) FIG. 1B
FIG. 1B is a partial, enlarged, cross-sectional view illustrating a slurry interaction between a wafer surface and a polishing pad.
Figure 1C:
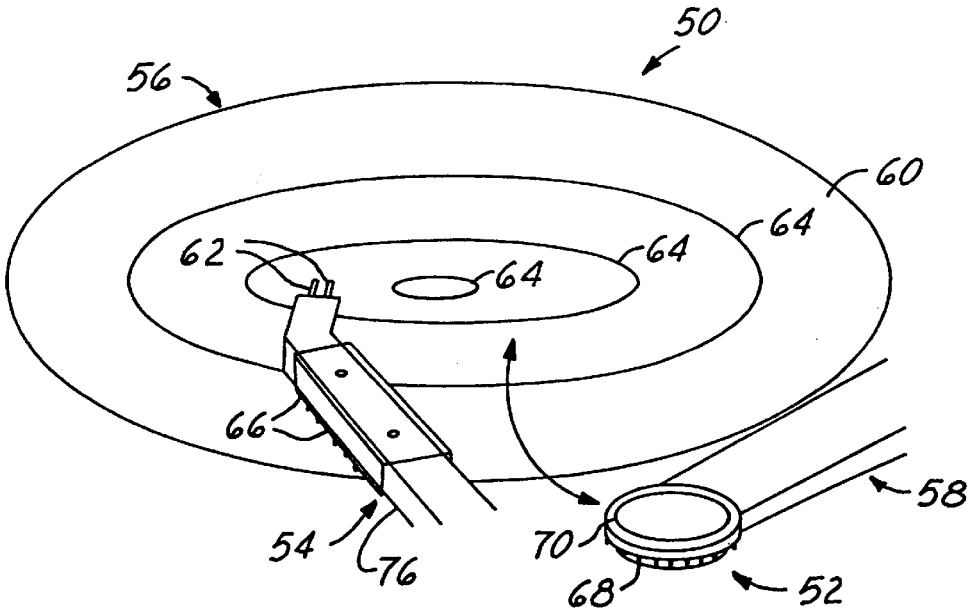
(PRIOR ART) FIG. 1C
FIG. 1C is a perspective view of a typical chemical mechanical polishing apparatus with a pad conditioning head mounted therein.
Figure 2:
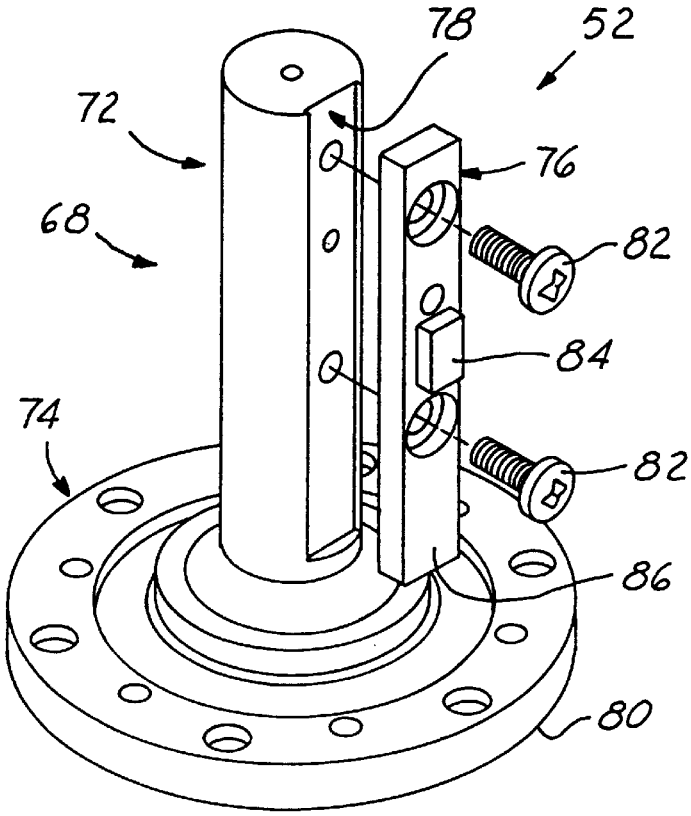
(PRIOR ART) FIG.2
FIG. 2 is a perspective view of a conventional hub shaft and hub spacer to be assembled together.
Figure 3:
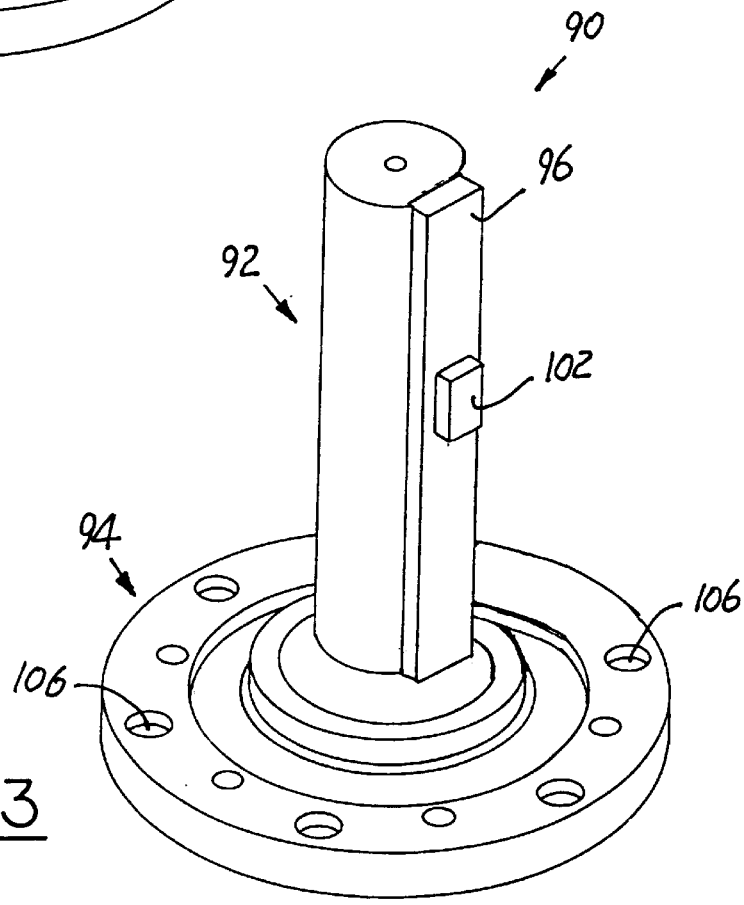
FIG. 3 is a perspective view of the present invention one-piece hub shaft.

Referring now to FIG. 3, wherein a present invention conditioning head 90 is shown. Conditioning head 90 is constructed of a one-piece hub shaft 92 attached integrally at a lower end to a circular disc 94. A flat surface 96 is formed on one side of the hub shaft 92, to a depth of at least 2 mm, and preferably of at least 4 mm. The flat surface may be formed in a rectangular shape corresponding to the shape of the recessed slot (not shown) in the hub frame 70 (FIG. 1*c*).

As shown in FIG. 3, the flat surface 96 is provided with a key 102 which may be integrally formed or may be separately formed and then assembled to the flat surface by a technique such as welding. The dimensions of the key 102 should be approximately equal to, or slightly smaller than the dimensions of the recessed slot (not shown) provided in the center aperture (not shown) of the hub frame 70 (FIG. 1C). This allows a frictional engagement between the key 102 and the recessed slot (not shown) which can be made by pressing the one-piece hub shaft 92 into the hub frame 70. A rotational motion or a linear motion of the hub frame may be transferred to the one-piece hub shaft 92 through the flat surface 96 and the key 102. The shape and dimensions of the key 102 may be suitably chosen to fit the shape of the recessed slot in the center aperture of the hub frame (not shown).

In the circular disc 94 that is integrally formed with the hub shaft 92, is provided with mounting holes 106 for mounting thereto a conditioning disc, i.e. a diamond disc, used for conditioning a CMP polishing pad. The present invention novel apparatus of the conditioning head 90 therefore not only allows an easy assembly between the hub frame 70 and the one-piece hub shaft 92, but also allows a more uniform torque transfer without causing localized stress concentration which would otherwise fail the components.

The present invention novel apparatus and method for transferring a rotational torque from a hub frame to a one-piece hub shaft for driving a pad conditioning disc mounted thereon is therefore amply described in the above description and in the appended drawings of FIG. 3.

While the present invention has been described in an illustrative manner, it should be understood that the terminology used is intended to be in a nature of words of description rather than of limitation.

Furthermore, while the present invention has been described in terms of a preferred embodiment, it is to be appreciated that those skilled in the art will readily apply these teachings to other possible variations of the inventions.

The embodiment of the invention in which an exclusive property or privilege is claimed are defined as follows.

What is claimed is:

1. A method for transferring a torque from a hub frame to a one-piece hub shaft comprising the steps of:

providing a hub frame of generally circular configuration having a center aperture therethrough adapted for receiving a one-piece hub shaft;

providing a one-piece hub shaft of elongated shape having generally a circular cross-section and a disc integrally formed at a lower end, said one-piece hub shaft having a flat surface along a periphery and a full length of the shaft and a key integrally formed on said flat surface having at least two step heights; and inserting said one-piece hub shaft into said hub frame by engaging said flat surface and said key of the one-piece hub shaft to a recessed slot in said center aperture of the hub frame such that rotational torque of said hub frame is transferred to said hub shaft.

2. A method for transferring a torque from a hub frame to a one-piece hub shaft according to claim 1 further comprising the step of transferring a rotational motion from said one-piece hub frame to said hub shaft and driving a conditioning disc mounted on said circular disc.

3. A method for transferring a torque from a hub frame to a one-piece hub shaft according to claim 1 further comprising the step of transferring an up-and-down motion from said hub frame to said one-piece hub shaft and engaging or disengaging a conditioning disc mounted on said circular disc to or from a polishing pad.

4. A method for transferring a torque from a hub frame to a one-piece hub shaft according to claim 1 further comprising the step of forming said flat surface on said hub shaft to a depth of at least 2 mm for transferring said rotational torque.

5. A method for transferring a torque from a hub frame to a one-piece hub shaft according to claim 1 further comprising the step of providing said key on said flat surface of the one-piece hub shaft in a rectangular shape for engaging said recessed slot in said hub frame.

6. A method for transferring a torque from a hub frame to a one-piece hub shaft according to claim 1 further comprising the step of mounting a conditioning disc on said circular disc on said one-piece hub shaft.

7. A method for transferring a torque from a hub frame to a one-piece hub shaft according to claim 1 further comprising the step of mounting said apparatus in a chemical mechanical polishing machine.

8. An apparatus for transferring a torque from a hub frame to a one-piece hub shaft comprising:

a hub frame of generally circular configuration having a center aperture therethrough adapted for receiving a one-piece hub shaft; and a one-piece hub shaft of elongated shape having generally a circular cross-section and a disc integrally formed at a lower end, said one-piece hub shaft having a flat surface along a periphery and a full length of the shaft and a key integrally formed on said flat surface having at least two step heights such that said flat surface and said key intimately engage an opening in said hub frame for transferring a rotational torque from said hub frame to said hub shaft.

9. An apparatus for transferring a torque from a hub frame to a one-piece hub shaft according to claim 8, wherein said hub frame further comprises a slot recess in said center aperture adapted for receiving said flat surface and said key on said one-piece hub shaft.

10. An apparatus for transferring a torque from a hub frame to a one-piece hub shaft according to claim 8, wherein said hub frame transfers a rotational motion to said one-piece hub shaft for driving a conditioning disc mounted on said circular disc.

11. An apparatus for transferring a torque from a hub frame to a one-piece hub shaft according to claim 8, wherein said hub frame transfers an up-and-down motion to said one-piece hub shaft for engaging and disengaging a conditioning disc mounted on said circular disc to and from a polishing pad.

12. An apparatus for transferring a torque from a hub frame to a one-piece hub shaft according to claim 8, wherein said flat surface on said hub shaft has a depth of at least 2 mm for transferring said rotational torque.

13. An apparatus for transferring a torque from a hub frame to a one-piece hub shaft according to claim 8, wherein said key on said hub shaft having a rectangular shape for engaging said opening in said hub frame.

14. An apparatus for transferring a torque from a hub frame to a one-piece hub shaft according to claim 8, wherein said circular disc on said hub shaft being adapted for receiving a conditioning disc thereon.

15. An apparatus for transferring a torque from a hub frame to a one-piece hub shaft according to claim 8, wherein said apparatus being adapted for mounting into a chemical mechanical polishing apparatus.

* * * * *